US011208250B2

(12) United States Patent
Weyrauch

(10) Patent No.: US 11,208,250 B2
(45) Date of Patent: Dec. 28, 2021

(54) PALLET CONTAINER WITH PLASTICS INNER CONTAINER

(71) Applicant: MAUSER-WERKE GMBH, Bruehl (DE)

(72) Inventor: Detlev Weyrauch, Kreuzau-Untermaubach (DE)

(73) Assignee: MAUSER-WERKE GMBH, Bruehl (DE)

( * ) Notice: Subject to any disclaimer, the term of this patent is extended or adjusted under 35 U.S.C. 154(b) by 18 days.

(21) Appl. No.: 16/630,279

(22) PCT Filed: Jul. 13, 2018

(86) PCT No.: PCT/EP2018/000356
§ 371 (c)(1),
(2) Date: Jan. 10, 2020

(87) PCT Pub. No.: WO2019/011468
PCT Pub. Date: Jan. 17, 2019

(65) Prior Publication Data

US 2020/0165048 A1 May 28, 2020

(30) Foreign Application Priority Data

Jul. 13, 2017 (DE) ..... 10 2017 006 653.1

(51) Int. Cl.
*B65D 77/04* (2006.01)

(52) U.S. Cl.
CPC ..... *B65D 77/0466* (2013.01)

(58) Field of Classification Search
CPC ..... B65D 19/00; B65D 19/06; B65D 21/02; B65D 77/04; B65D 77/0466
(Continued)

(56) References Cited

U.S. PATENT DOCUMENTS 3,617,677 A 11/1971 Ritter et al.
5,678,688 A 10/1997 Schutz
(Continued)

FOREIGN PATENT DOCUMENTS

EP 0734967 A2 10/1996
EP 2301860 B1 5/2013
(Continued)

OTHER PUBLICATIONS

International Preliminary Report on Patentability for International Patent Application No. PCT/EP2018/000356, dated Jul. 10, 2019.
(Continued)

*Primary Examiner* — Bryon P Gehman
(74) *Attorney, Agent, or Firm* — Marshall, Gerstein & Borun LLP

(57) ABSTRACT

A pallet container having a thin-walled rigid inner container including thermoplastic plastics material, having a tubular grid frame, which tightly encloses the plastics inner container as a support covering and includes horizontal and vertical tubular rods, is disclosed. At least one member selected from the group consisting of at least one of the vertical tubular rods and at least one of the horizontal tubular rods has a square-shaped or round hollow profile as the original basic profile and a tube profile that has been changed by mechanical shaping. The original basic profile of at least one member selected from the group consisting of at least one of the horizontal tubular rods and at least one of the vertical tubular rods is constructed so as to be increased by a predeterminable amount via an intersection region of the horizontal tubular rods and vertical tubular rods, which are welded to each other.

16 Claims, 5 Drawing Sheets

(58) Field of Classification Search
USPC ..... 206/386; 220/9.1–9.3
See application file for complete search history.

(56) References Cited

U.S. PATENT DOCUMENTS

| | | | | |
|---|---|---|---|---|
| 6,290,082 | B1 * | 9/2001 | Van Giezen | B23K 33/006 206/386 |
| 6,719,162 | B2 * | 4/2004 | Przytulla | B65D 19/06 206/386 |
| 7,108,133 | B2 * | 9/2006 | Przytulla | B65D 19/06 206/386 |
| 7,648,040 | B2 * | 1/2010 | Przytulla | B65D 19/06 220/9.1 |

FOREIGN PATENT DOCUMENTS

| | | | |
|---|---|---|---|
| WO | WO-0189955 | A1 | 11/2001 |
| WO | WO-04096660 | A1 | 11/2004 |

OTHER PUBLICATIONS

International Search Report for International Patent Application No. PCT/EP2018/000356, dated Sep. 18, 2018.

* cited by examiner

PALLET CONTAINER WITH PLASTICS INNER CONTAINER

CROSS-REFERENCE TO RELATED APPLICATIONS

This is the United States national phase of International Application No. PCT/EP2018/000356 filed Jul. 13, 2018, which claims priority to German Application No. DE 10 2017 006 653.1 filed Jul. 13, 2017, the entire contents of each of which are hereby incorporated herein by reference.

FIELD OF THE DISCLOSURE

The invention relates to a pallet container for storing and for transporting fluid or flowable filling materials having a thin-walled inner container comprising thermoplastic plastics material, having a tubular grid frame which tightly encloses the plastics inner container as a support covering and which comprises horizontal and vertical tubular rods which are welded to each other, and having a rectangular base pallet on which the plastics container is positioned and to which the tubular grid frame is securely connected.

BACKGROUND

In the chemical industry, pallet containers (commonly referred to as "Intermediate Bulk Containers" or "IBC"; therefore, also abbreviated to "IBC" or "IBCs" below) are extensively used primarily for transporting fluid chemicals. These chemical products are mainly classified as hazardous fluid filling materials. Therefore, only packaging containers having a corresponding hazardous goods permit may also be used for transporting and storing such products. In order to obtain a hazardous goods permit, the pallet containers are subjected to a construction type examination, for which tests with regard to different loading states have to be passed, such as, for example, an internal pressure test, a drop test, a stacking load test, a vibration test on a vibrating table, and many more. In the case of the internal pressure occurring, the cuboid plastics inner container which is filled with fluid filling material attempts to expand and to bulge in the four side walls thereof and in the upper base. Filled IBCs are generally transported, for example, on a lorry as a double stack so that the lower IBC must further carry the stack load of the upper IBC. In particular in the case of lorry transport operations of filled IBCs, substantial surge movements of the fluid filling material are produced as a result of the transport impacts and movements of the transport vehicle—particularly on poor roadways—whereby constantly changing pressure forces are applied to the walls of the inner container which again lead to radial oscillation movements of the tubular grid frame in the case of rectangular pallet containers and which constitute dynamic permanent oscillations with changing tension/pressure loads on the weld spots at the intersection locations of the tubular rods of the grid. In the case of overloads or after relatively long loading times, there may be produced in the case of the tubular rods fatigue breakages and breaking of weld spots at the intersection locations. In the case of pallet containers with a hazardous goods permit, special measures for reducing such damage are often provided for.

The publication U.S. Pat. No. 5,678,688 (=EP-A0 734 967) discloses a pallet container in which the vertical and horizontal tubular rods comprise a round tube basic profile which is powerfully compressed at the welded intersection locations in order to obtain at that location a 4-point support for an electrical resistance welding of the intersecting tubes. In this known embodiment, however, a disadvantage is that the round tube basic profile of the vertical and horizontal grid rods of the tubular grid frame is substantially pressed particularly and only in the region of the intersection locations at the side of the weld spots, and is substantially less in terms of the bending resistance torque than in the remaining region. In addition, the round tube basic profile is again dented more deeply directly beside the intersection locations in order to reduce the loading of the weld spots from the occurrence of bending stresses in the same dent and is therefore further weakened.

In a pallet container known from WO0189955 A1, the horizontal and vertical grid rods of the tubular grid frame comprise a hollow profile, potentially a square tube as a basic profile. In order to increase the transport durability and to increase the resistance of the tubular grid frame against higher transport stresses or against long-term oscillation loads, there is provision for the vertical and/or horizontal tubular rods to be substantially free from formations in the contact plane thereof in the region of the intersection locations, and for the tubular rods each to be provided laterally beside an intersection location or welding location with corresponding formations in the basic tubular profile—as intended bending locations—which have a specific minimum spacing of at least one tenth of the tubular profile width from the welding locations. An increased bending resilience of the tubular grid frame is obtained when in the vertical and/or horizontal tubular rods at least two formations are provided between two intersection locations.

In another pallet container which is known from WO2004096660 A1, only one elongate formation is provided in the vertical and/or horizontal tubular rods between two intersection locations.

There is further known from the publication EP2301860 B1 a pallet container having a square basic tubular profile, wherein the dents or recesses are constructed with a spacing from the intersection locations which is substantially equal to or longer than the width of the rods, and that the recesses are constructed only at the side of the rods in which the welded connections are arranged.

The known constructions of the different pallet containers with trapezoidal, round tube or square tube grid rods with a closed basic profile all have in common the disadvantage that the basic profile of the tubular grid rods are dented at specific locations laterally beside the weld spots in order to relieve the stress peaks at the weld spots and consequently the originally present rigidity of the non-shaped tubular rods is reduced and decreased individually, as is that of the entire walls of the tubular grid frame.

GENERAL DESCRIPTION

The object of the present invention is to increase the rigidity of the tubular grid frame of pallet containers (IBCs) and therefore to ensure an increased level of security of such large containers during use, in particular for hazardous fluid filling materials.

This object is achieved with the special features of patent claim 1. The features in the subsidiary claims describe additional advantageous embodiments of the pallet container according to the invention.

The technical teaching proposed sets out a possible method for being able to increase the rigidity of the tubular grid frame of pallet containers with a comparatively simple constructive measure. According to the invention the original basic profile of at least one horizontal and/or vertical tubular rod is constructed in an increased manner so as to extend by a predeterminable amount in the longitudinal direction of the tubular rods via an intersection region of the horizontal and vertical tubular rods which are welded to each other or is provided with an increased rear region.

Unlike all previously known solutions, here the basic profile of the tubular rods is not dented and weakened but instead is constructed to be reinforced and strengthened by the increased rear region which extends via an intersection region of the horizontal and vertical tubular rods which are welded to each other. In this case, the original basic profile is in the an increase of the basic tubular profile which extends in the longitudinal direction of the tubular rods is constructed by mechanical shaping from the original basic profile by means of a lateral pressing pressure action and has a comparatively narrow rear line which extends in the longitudinal direction of the tubular rods. By increasing the construction height of the tubular profile in the intersection region of the original basic profile to form the shaped practically triangular hollow profile, the bending rigidity of the tubular rods in this region is increased quite considerably. Taken overall, this then advantageously also leads to an increased or improved rigidity of the entire tubular grid frame. In turn, the bulging of the side walls of the tubular grid frame is thereby perceptibly reduced by the action of the hydrostatic pressure of a filled pallet container. The more rigid side walls of the tubular grid frame also better withstand the occurrence of an inner pressure as a result of temperature changes, for example, by thermal expansion in the event of solar irradiation. Furthermore, the oscillations of the side walls of the tubular grid frame during transport shocks and surge loads by the fluid filling material are also reduced. This generally results in lower stress loads on the tubular rods themselves and on the individual weld spots at the intersection locations of the tubular grid rods. As a result of these structural measures, the rigidity of the tubular grid frame of pallet containers is not reduced but instead increased and, in connection therewith, an increased security of the IBCs according to the invention is ensured during use, in particular for hazardous fluid filling materials.

In an embodiment of the invention, there is provision for the increased rear region to be arranged with the horizontal tubular rods only at an outwardly directed side of the tubular rods and/or with the vertical tubular rods only at an inwardly directed side of the tubular rods with respect to the tubular grid frame. The important aspect for improving the rigidity of the tubular grid frame is that the height of the tubular profiles be increased or enlarged in a radial direction or perpendicularly to the side wall of the tubular grid frame. If, therefore, the increased rear region is arranged on a vertical rod, it is intended to be constructed at the inwardly directed side with respect to the tubular grid frame. If the increase is arranged on a horizontal tubular rod, the increased rear region is intended to be constructed at the outwardly directed side. In this construction, there are no problems in welding the horizontal and vertical tubular rods located one on the other at the intersection locations.

In another embodiment of the invention, there is provision for the increased rear region to have a definitively delimited extent in the longitudinal direction of the tubular rods. An optimum increase of performance or increase of rigidity of the tubular grid frame is achieved if the extent of the increased rear region in the longitudinal direction of the tubular rods is between twice and ten times, preferably five times, the width of the tubular rods or a diameter of the tubular rods. Tubular rods having a square cross-section (also referred to as "square profile" below) are particularly suitable for forming the increased rear region in the simplest and most effective manner in terms of the technical method, wherein the profile does not have to form a perfect square. Thus, for example, profiles having slight differences in the heights of the side walls or ones having side walls which are not quite parallel are also particularly suitable square profiles in this sense.

The present invention is distinguished by the following special features for a preferred embodiment:

the increased rears are produced in principle only in the intersection regions of the tubular rods;

the increased rears are produced in principle for the vertical tubular rods only so as to be directed inwards (with respect to the tubular grid frame);

the increased rears are produced in principle for the horizontal tubular rods only so as to be directed outwards (with respect to the tubular grid frame);

the increased rears are produced in the intersection regions preferably in the region of the lower half of the side walls of the tubular grid frame;

the increased rears are produced in the intersection regions preferably in the region of the side walls of the tubular grid frame with maximum convexity, that is, the central region of the second and third horizontal rods from the bottom in the tubular grid frame.

BRIEF DESCRIPTION OF THE DRAWINGS

The invention is explained and described in greater detail below with reference to drawings of schematically illustrated embodiments, in which.

DETAILED DESCRIPTION

Figure 1:
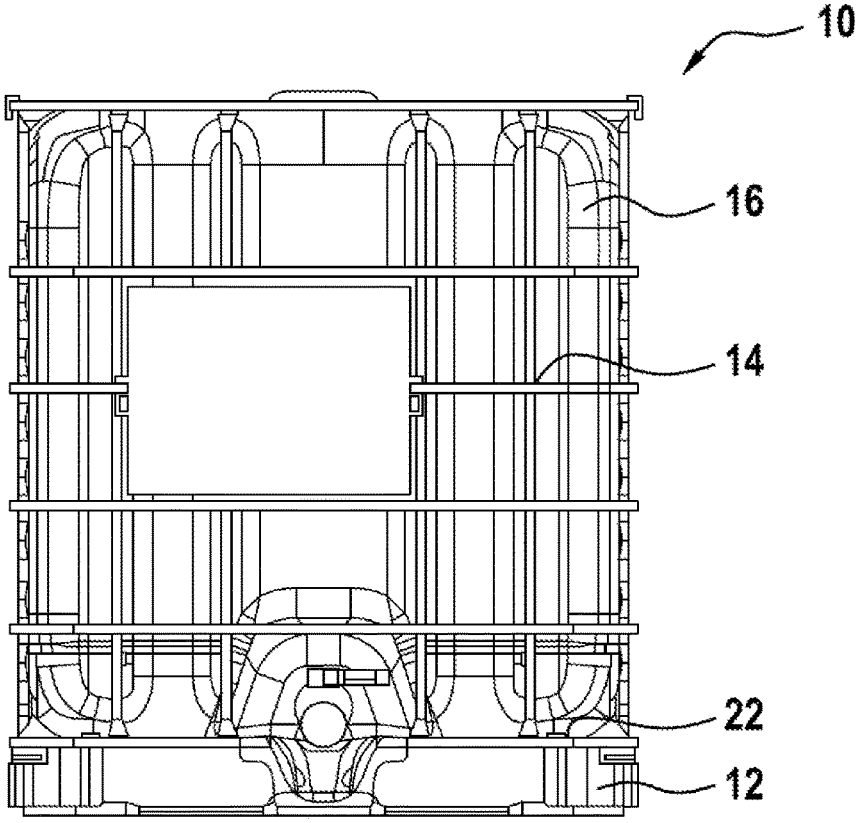
FIG. 1 is a front view of an IBC according to the invention.

In FIG. 1, there is generally designated 10 a pallet container according to the invention for storing and transporting in particular hazardous fluid or flowable filling materials. For use for storing and/or transporting hazardous filling materials, the pallet container 10 complies with particular test criteria and is provided with a corresponding official hazardous goods permit. In an embodiment for a filling material volume of approximately 1000 l, the pallet container 10 has standardised dimensions having a length of approximately 1200 mm, a width of approximately 1000 mm and a height of approximately 1150 mm. The main elements of the pallet container 10 comprise a thin-walled rigid inner container 12 which is produced from a thermoplastic plastics material using the blow-moulding method, a steel tube grid frame 14 which tightly encloses the plastics inner container 12 as a support covering and a base pallet 16, on which the plastics inner container 12 is positioned and to which the steel tube grid frame 14 is securely connected. The outer tubular grid frame 14 comprises horizontal and vertical steel tubular rods 18, 20 which are welded to each other. The closed basic profile BP of the horizontal and vertical tubular rods 18, 20 has no formations or dents which reduce the profile height transversely relative to the longitudinal direction of the tubular rods.

The base pallet 16 is constructed as a composite pallet in the version illustrated. An identification panel 22 comprising thin sheet steel for identifying the respective fluid filling material is fixed to the front side of the tubular grid frame 14. A removal fitting 24 is connected at the centre of the base of the plastics inner container 12 for removing the fluid filling material.

The horizontal tubular rods 18 are securely welded in intersection regions 26 with the vertical tubular rods 20 of the tubular grid frame 14 via a 4-point support by means of conventional resistance pressure welding. In the present case, the steel tube grid frame 14 comprises eighteen vertical tubular rods 20 each with a length of approximately 1000 mm and six circumferential horizontal tubular rods 18 which are constructed by means of four 90° bends with a total length of approximately 4400 mm and a connection location of the two pipe ends to form a rectangular tubular ring. Inside the tubular grid frame 14, there are seventy-two (72) pure intersection locations 26 and eighteen (18) upper and eighteen (18) lower intersection joint locations 28. At the intersection joint locations 28, the upper and lower ends of the vertical tubular rods 20 are securely welded to the uppermost and the lowermost horizontally extending tubular rod 18. The pallet container 10 can also be constructed as a large container with different volume sizes between 500 I and 1300 I.

Figure 2:
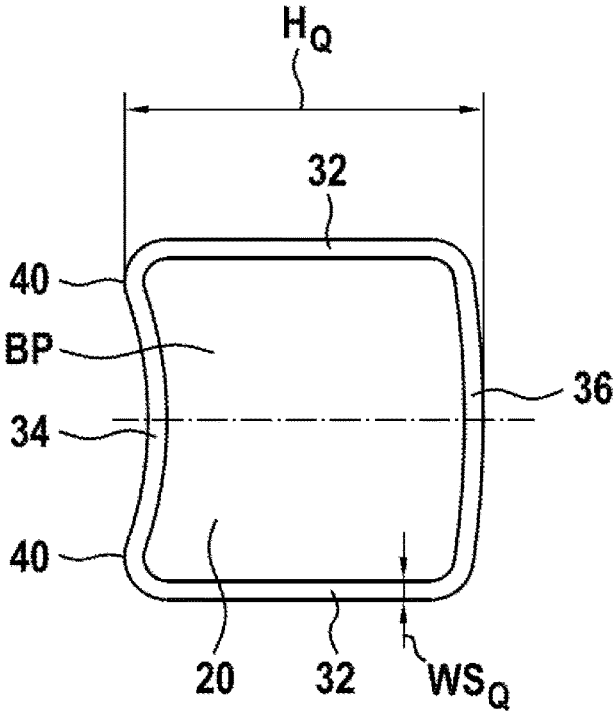
FIG. 2 is a cross-sectional view of a preferred embodiment of a tubular rod basic profile BP with a substantially square cross-section.

In FIG. 2, a tubular rod basic profile BP with a practically square tubular cross-section is illustrated as a cross-sectional view as a preferred embodiment. This original basic profile BP as a square profile—here, of a vertical tubular rod 20—does not have any formations or dents transversely relative to the longitudinal direction of the tubular rods. The outer dimensions are approximately 16×16 mm and consequently the height $H_{(Q)}$ as a side length of the square profile is also 16 mm. As a result of the increase of the rigidity of the steel tube grid frame according to the invention, the previous wall thickness of the tubular rods of 1.0 mm can be reduced, wherein the square profile then has a reduced wall thickness of from 0.7 mm to 1.0 mm, preferably 0.9 mm.

In a preferred embodiment, there is provision for the square profile of the vertical tubular rods 20 to have a wall thickness of 0.8 mm and the square profile of the horizontal tubular rods 18 to have a wall thickness of 0.9 mm. The weight and the material costs of the pallet container can thereby be reduced while retaining a high wall rigidity level.

Preferably, the basic square profile BP has two opposing parallel straight side walls 32 and two opposing practically parallel, slightly curved side walls 34, 36, wherein one curved side wall 34 is constructed to be slightly concave inwards and the other curved side wall 36 is constructed to be slightly convex outwards. The slightly concavely inwardly curved side walls of the tubular rods 18, 20 have at the two lateral outer edges thereof a planar rear line 40 which extends in the longitudinal direction of the tubular rods.

At the intersection locations 26, the horizontal tubular rods 18 and the vertical tubular rods 20 are located on each other with the slightly concavely inwardly curved side walls 34 or with the two outer, longitudinally extending rear lines 40 thereof and form the necessary 4-point supports for welding the tubular rods 18, 20. The slightly convexly outwardly formed side wall 36 of the square basic profile is, in the region of the intersection locations 26 in which it is desirable and provided for, easier to shape as a result of pressing pressure applied at both sides into a triangular shaping profile with a centrally formed rear piece 30. The rear-like increased portions are produced from the basic profile square tube as a result of cold-forming by means of simple hydraulic pressing tongs.

Figure 3:
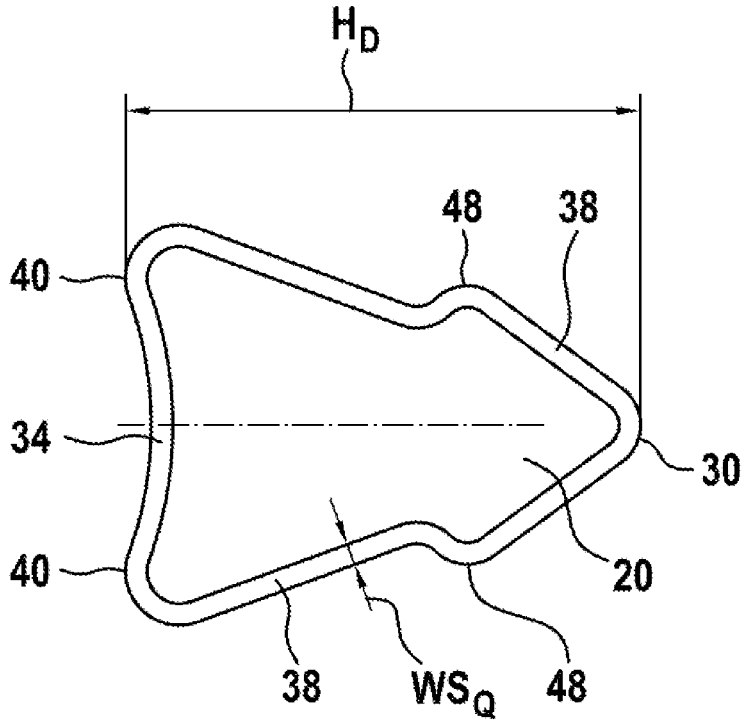
FIG. 3 is a cross-sectional view of the tubular rod profile according to FIG. 1 after shaping with a substantially triangular cross-section.

A tubular rod profile which is processed and shaped in such a manner in the region of the intersection locations 26 and which has a substantially triangular cross-section and a centrally formed rear piece 30 according to the present invention can be seen in FIG. 3 as a cross-sectional view.

In a square basic profile having a side length or height $H_{(Q)}$ of 16 mm there results a height $H_{(D)}$ of the triangular tubular rod profile of approximately 20.5 mm in the region of the triangular cross-section from the slightly concavely inwardly curved side wall equal to the basic wall for the 4-point contact locations for welding the intersecting tubular rods as far as the tip of the central rear piece 30, depending on the size of the radius at the rear tip. In this case, the two opposing side walls 32 which extend linearly and in a parallel manner and the slightly convexly outwardly curved side wall 36 are each shaped by half into two equal-sided triangle side walls 38.

During the shaping operation, two outwardly directed humps 48 are produced—as a cross-sectional view—from the two 90° bends between the two opposing side walls 32 which extend linearly in a parallel manner and the slightly convexly outwardly curved side wall 36 in the two shaped triangle side walls 38. The square basic profile BP was originally shaped in a roller type roll stand from a round steel tube to form a square profile. In this case, the four 90° bends between two adjacent side walls were formed by cold-forming. During cold-forming, a local increase in strength is produced as a result of structure changes in the steel material. In the region of the shaped triangular cross-section, the two 90° bends which are adjacent to the slightly convexly outwardly curved side wall 36 are bent open again. As a result of the increase in strength in the two 90° bends, the bending back is not carried out completely and there remain the two humps 48 in the two equal-sided triangle side walls 38.

The processing and shaping of the basic profile tubular rods is not carried out here in contrast to the previously known solutions in a direction perpendicular to the plane of the grid walls but instead in a direction parallel with the plane of the grid walls, wherein in order to form the central rear piece 30 a pressing pressure is applied by means of correspondingly formed pressing tools at the same time by two opposite side walls to the provided region of the tubular rod. In this case, this pressing pressure is applied to the two opposite side walls 32 which extend linearly in a parallel manner, beginning in a region or portion of the square basic profile which adjoins or is adjacent to the slightly convexly outwardly curved side wall 36. This can, for example, be brought about by means of a pressing tool having two pressing stamps which move towards each other and the tips of which are chamfered accordingly at the front so that in the end position a V-shaped gap between the tips of the pressing stamps and a practically triangular or triangle-like tube cross-section with an increased tube profile height of the shaped region of the tubular rod are produced. This shaping operation can also be carried out accordingly by means of a pressing tongs type tool, wherein two tong jaws act via a pivot point on the two opposite side walls 32 which extend linearly in a parallel manner. In this case, only the slightly concavely inwardly bent side wall 34 remains unshaped for the 4 welding spots in the intersection region 26 of the horizontal and vertical tubular rods 18, 20.

The basic profile square tube has a basic side wall which is curved slightly inwardly, whereby outer-side longitudinal ribs for the 4-point resistance welding are produced. During the cold-forming, the two 90° bends which are opposite the basic side wall are bent open and brought to the greatest possible degree to a rectilinear extent while the straight side wall which is opposite the basic side wall is shaped at the centre to form a comparatively narrow bend with a small radius.

Figure 4:
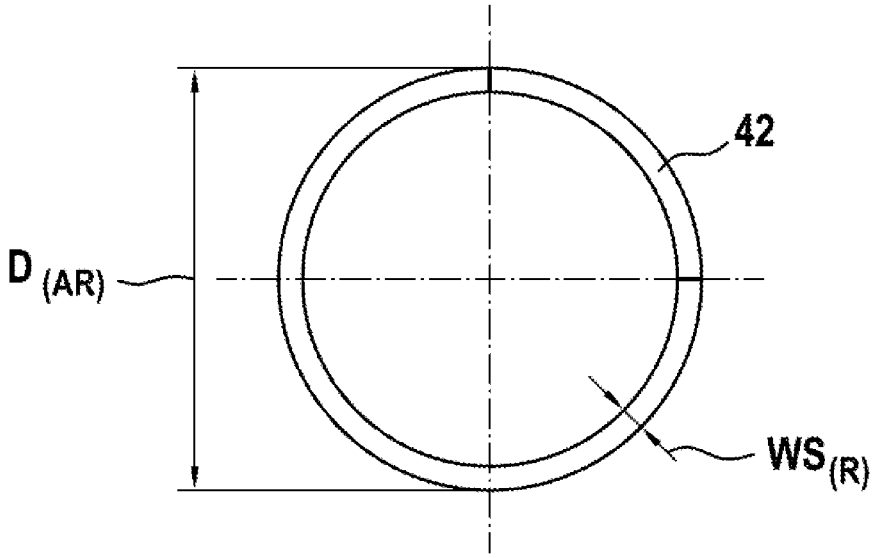
FIG. 4 is a cross-sectional view of another embodiment of a tubular rod basic profile with a circular cross-section.
Figure 5:
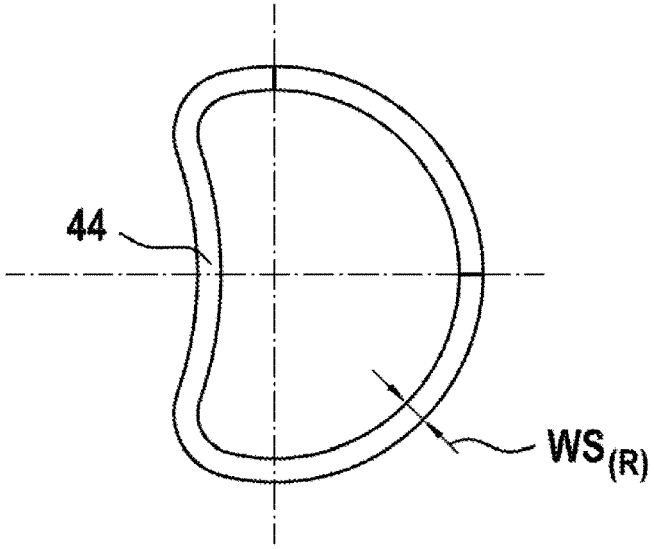
FIG. 5 is a cross-sectional view of the tubular rod profile according to FIG. 4 after a first shaping step to form a weldable cross-section with a 4-point support of the intersecting tubular rods.
Figure 6:
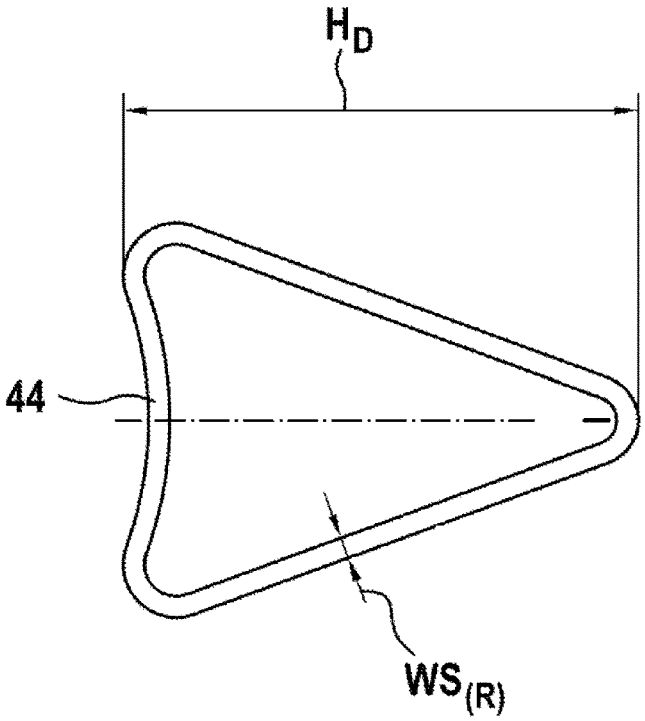
FIG. 6 is a cross-sectional view of the tubular rod profile according to FIG. 4 after further shaping to form a triangular cross-section.

Another embodiment of a known tubular rod basic profile is illustrated in FIG. 4 as a cross-section. This original tubular bar basic profile is constructed as a round tube profile 42 and has a circular cross-section with an outer diameter $D_{(AR)}$ of approximately 18 mm and a wall thickness of 1.0 mm. In order to obtain a corresponding mutual support of the tubular rods in the intersection regions for a 4-point weld, in a first shaping step—as illustrated in the following FIG. 5—a side of the round tubular profile is shaped radially by a small amount so that a slightly concave or slightly inwardly curved wall piece 44 is formed with outer-side longitudinal ribs or longitudinal humps which form a 4-point support in the case of intersecting tubular rods. As a result of the denting of the round tubes in order to form the four weld contact points, the round tube of known pallet containers is subjected to a powerful loss of rigidity or bending resistance moment. This loss of rigidity can again be compensated for well by shaping in an additional shaping step to form a practically triangular cross-sectional profile with the introduction of increased rear regions 30, as can be seen in FIG. 6. This embodiment with a triangular hollow profile also has in the region of the increased rear region 30 a profile height $H_D$ of at least 20 mm.

Figure 7:
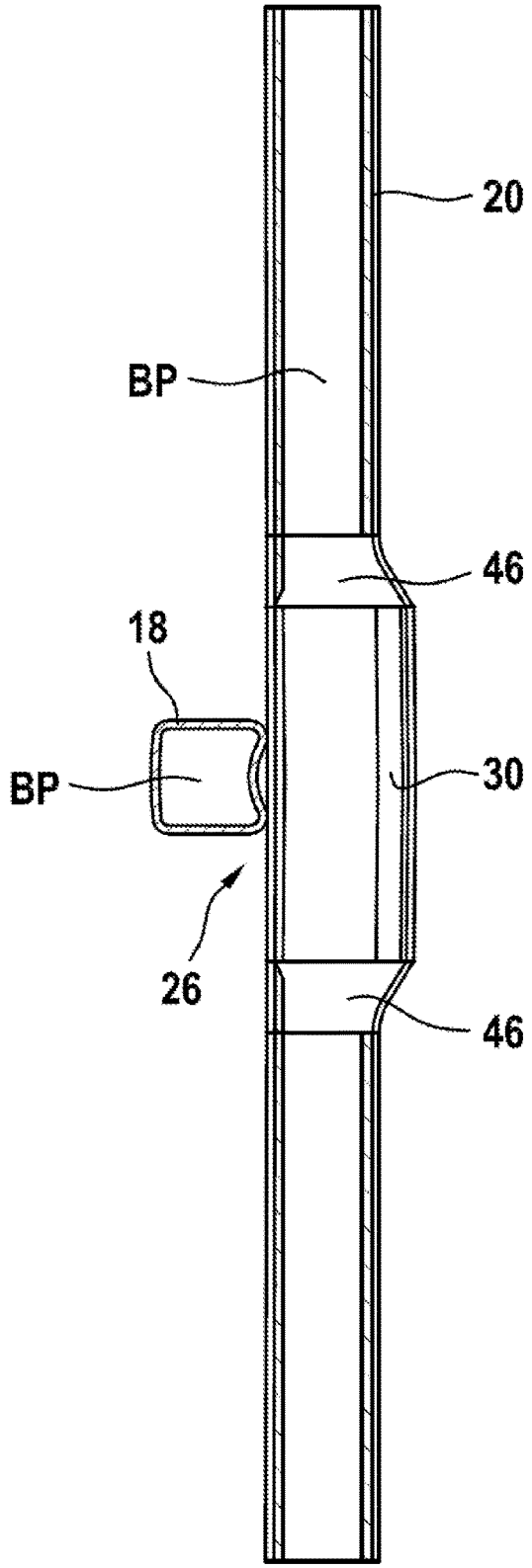
FIG. 7 is a partial side view of a vertical tubular rod with a square cross-section and FIG. 8 is a partial plan view of a vertical tubular rod with a square cross-section from the inner side from the tubular grid frame.

FIG. 7 illustrates in an intersection region 26 a lateral part-view of a vertical tubular rod 20 with a square cross-section. The horizontal tubular rod 18 has the same square cross-section of the basic profile BP. In the intersection region 26, the original square basic profile BP of the vertical tubular rod 20 was shaped to form a practically triangular hollow profile with a central increased rear region 30. The central increased rear region 30 which is constructed by mechanical shaping by means of a lateral pressing pressure action from the original basic profile has a narrow rear which extends in the longitudinal direction of the tubular rods, wherein the increased rear region 30 is limited to a defined extent in the longitudinal direction of the tubular rods. This extent of the increased rear region 30 in the longitudinal direction of the tubular rods is intended to be between two times and ten times, preferably five times, the width of the tubular rod or diameter of the tubular rod (in the case of a round tube).

There is produced at both sides between the original non-shaped basic profile and the central increased rear region 30 which is constructed by shaping a transition region 46 which extends obliquely. These obliquely extending transition regions 46 are produced in that, in order to form the increased rear region for the intersection regions of the tubular rods by means of correspondingly formed pressing tools, a pressing pressure is applied to the provided region of the basic tubular profile in a direction parallel with the plane of the grid walls at the same time by two opposing parallel side walls. In this case, the pressing pressure is applied to the two opposite side walls which extend linearly in a parallel manner substantially only in the region or portion of the square basic profile which adjoins or is adjacent to the slightly convexly outwardly bent side wall.

The shaping operation is carried out in this instance in such a manner that the pressing pressure is applied to the two opposite side walls which extend parallel, for example, by two tips, chamfered at the front, of two pressing stamps of a pressing tool which are moved towards each other or the pivotable jaws of a set of pressing tongs, wherein in the end position a V-shaped gap is produced between the tips of the pressing stamps or the jaws of the set of pressing tongs and thereby a practically triangular tube cross-section with an increased tubular profile height is formed in the shaped region of the tubular rod.

Figure 8:
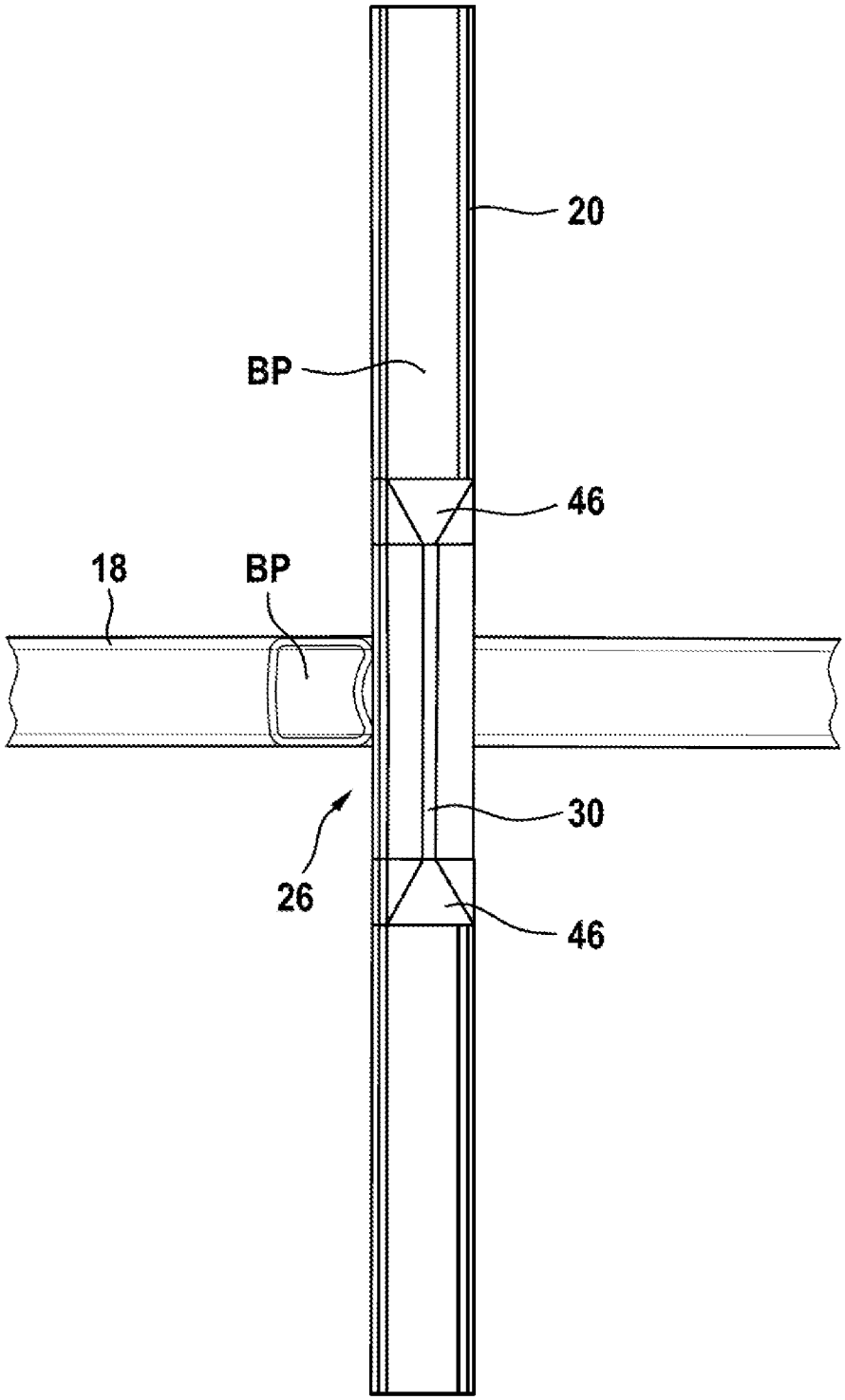

To this end, FIG. 8 shows as a partial plan view of a vertical tubular rod 20 with a square basic cross-section from the inner side out of the tubular grid frame the shaped triangular cross-sectional region of the vertical tubular rod 20 with the central increased rear region 30 which is formed by shaping and transition regions 46 which adjoin at two sides. The longitudinal extent of the oblique transition regions 46 should be approximately once to twice the height of a side wall of the square basic profile, that is to say, between 15 and 35 mm, preferably approximately 20 mm.

If the specific case of an IBC which is filled with a fluid filling material and in which the filling material surges back and forth as a result of transport loads and thereby acts on the side walls of the tubular grid frame with changing pressure forces is considered, this brings about dynamic permanent loads with constantly swelling and subsiding tensile and pressure stresses in the tubular profile, which can lead in the long term to cracks in the tubular profile regions which are most greatly stressed and the breakage of the weld spots in the intersection locations. In this case, the outward bulging of the side walls of the tubular grid frame is, as a result of the inner pressure in the plastics inner container, approximately twice as large as the inward "indentation" or rebound of the tubular grid frame as a result of the resilient restoring forces. In this case, therefore, flexural loads of different magnitudes in the radial direction occur on the tubular rods (=bending bars) of the tubular grid frame.

The magnitude for a resistance against bending is referred to as an axial resistance moment W or bending resistance moment. The resistance moment constitutes in the technical mechanism a variable which is derived only from the geometry (form and dimensions) of a bar cross-section and which is a measurement for the resistance which a bending bar applies during loading counter to the occurrence of inner stresses. In this case, the largest stresses $\sigma_{max}$ in terms of value always occur in the peripheral fibres of the bending bar which have the greatest spacing from the neutral fibres. The resistance moment W of a bar cross-section is in a simple geometric relationship with the geometrical moment of inertia I, by means of which the shaping is calculated during the cross-section measurement in order to establish the bending rigidity of a bar during loading. The resistance moment W is defined as the quotient comprising the geometrical moment of inertia I, and the greatest stress $\sigma_{max}$. The unit for the resistance moment is $m^3$.

During comparison measurements relating to the bending rigidity of the square basic profile and the shaped triangular tube cross-section with an increased rear region, the following was found: the square basic profile has a geometrical moment of inertia $I_x$ in the order of approximately 1610 $mm^4$ while a geometrical moment of inertia $I_x$ of approximately 2000 $mm^4$ results for the triangular cross-sectional profile. This results in a substantial increase of approximately 24%.

In corresponding comparison measurements, a geometrical moment of inertia $I_x$ of approximately 1770 $mm^4$, which is further substantially reduced in the previously carried out formations and cross-sectional reductions in the intersection regions, resulted for an unshaped round tube profile of a known pallet container. In comparison, a high power increase could also be brought about here with a shaping of the round tube cross-section to form the triangular profile with an increased rear region and an increase of the geometrical moment of inertia $I_x$ to over 2000 $mm^4$.

Consequently, the present invention provides a cost-effective solution which is easy to apply and which functions correctly for an advantageous increase of the rigidity of the tubular grid frames of pallet containers. No additional material is required, but instead only a special and partial shaping of the tubular rod basic profile is applied, and, conversely, a material and cost saving can even be achieved by reducing the wall thickness of the tubular rods.

As a result, an increased level of security against the occurrence of damage resulting from excessive transport loads is ensured when using such large containers in particular for hazardous fluid filling materials.

The invention claimed is:

1. Pallet container for storing and for transporting flowable filling materials having a thin-walled rigid inner container comprising thermoplastic plastics material, having a tubular grid frame which tightly encloses the plastics inner container as a support covering and which comprises horizontal and vertical tubular rods which are welded to each other in intersection regions, and having a rectangular base pallet on which the plastics inner container is positioned and to which the tubular grid frame is securely connected, wherein at least one member selected from the group consisting of at least one of the vertical tubular rods and at least one of the horizontal tubular rods has, when considered in the longitudinal direction, a square-shaped or round hollow profile as the original basic profile and have, in certain regions, a tube profile that has been changed by mechanical shaping, characterised in that the original basic profile of at least one member selected from the group consisting of at least one of the horizontal tubular rods and at least one of the vertical tubular rods is constructed so as to be increased by a predeterminable amount via an intersection region of the horizontal tubular rods and the vertical tubular rods which are welded to each other or, the original basic profile of at least one member selected from the group consisting of at least one of the horizontal tubular rods and at least one of the vertical tubular rods is provided with an increased rear region wherein the original basic profile is shaped in the region of the increased rear region and has a practically triangular hollow profile, wherein the increased rear region is constructed by mechanical shaping from the original basic profile by means of a lateral pressing pressure action and has a narrow rear which extends in the longitudinal direction of the tubular rods.

2. Pallet container according to claim 1, characterised in that the increased rear region is arranged at an outwardly or inwardly directed side of the tubular rod with respect to the tubular grid frame.

3. Pallet container according to claim 1, characterised in that the increased rear region is one or more of constructed in a vertically extending tubular rod at an inwardly directed side and is arranged in a horizontally extending tubular rod at an outwardly directed side with respect to the tubular grid frame.

4. Pallet container according to claim 1, characterised in that the increased rear region has a definitively delimited extent in the longitudinal direction of the tubular rods.

5. Pallet container according to claim 1, characterised in that the extent of the increased rear region in the longitudinal direction of the tubular rods is between twice and ten times, the width of the tubular rods or a diameter of the tubular rods.

6. Pallet container according to claim 1, characterised in that the basic profile is constructed as a square tubular profile.

7. Pallet container according to claim 6, characterised in that the square profile of the tubular rods has a wall thickness of from 0.8 mm to 1.0 mm.

8. Pallet container according to claim 6, characterised in that the square profile of the vertical tubular rods has a wall thickness of 0.8 mm and the square profile of the horizontal tubular rods has a wall thickness of 0.9 mm.

9. Pallet container according to claim 6, characterised in that the square profile has two opposing parallel straight side walls and two opposing parallel, slightly curved side walls, wherein one curved side wall is constructed to be slightly concave inwards and the other curved side wall is constructed to be slightly convex outwards.

10. Pallet container according to claim 1, characterised in that the increased rear region f is constructed in the intersection regions only in the vertical tubular rods.

11. Pallet container according to claim 1, characterised in that the original basic profile is constructed as a round tubular profile.

12. Pallet container according to claim 1, characterised in that the triangular hollow profile has a profile height of at least 20 mm in the region of the increased rear region.

13. Pallet container according to claim 1, characterised in that the increased rear region is produced in the intersection regions preferably in the region of the side walls of the tubular grid frame with maximum convexity, that is in the central region of the second and third horizontal tubular rod from the bottom in the tubular grid frame.

14. Method for producing a triangular hollow profile from a square basic profile in a tubular grid rod of a tubular grid frame for a pallet container according to claim 6, characterised in that, in order to form the central rear piece for the intersection regions of the tubular rods by means of correspondingly formed pressing tools, a pressing pressure is applied to the provided region of the tubular basic profile in a direction parallel with the plane of the grid walls at the same time from two opposing parallel side walls.

15. Method according to claim 14,
characterised in that
the pressing pressure on the two opposing side walls which extend linearly in a parallel manner is applied substantially only in the region or portion of the square basic profile which adjoins or is adjacent to the slightly convexly outwardly curved side wall.

16. Method according to claim 14,
characterised in that
the pressing pressure on the two opposite side walls which extend parallel is produced in such a manner that the tips, chamfered at the front, of the pressing tools which are moved towards each other produce in the end position a V-shaped gap between the tips of the pressing tools and a triangular tube cross-section with an increased tubular profile height is formed in the shaped region of the tubular rod.

* * * * *